US006868848B2

(12) United States Patent
Boland et al.

(10) Patent No.: US 6,868,848 B2
(45) Date of Patent: Mar. 22, 2005

(54) CUTTING TOOL AND METHOD OF USING SAME

(75) Inventors: James Norman Boland, Forest Lake (AU); Kit Bunker, Birkdale (AU); Paul Edwin Willis, Elanora (AU)

(73) Assignee: The Commonwealth of Australia Commonwealth Scientific and Industrial Research Organization, Campbell (AU)

( * ) Notice: Subject to any disclaimer, the term of this patent is extended or adjusted under 35 U.S.C. 154(b) by 0 days.

(21) Appl. No.: 10/298,227

(22) Filed: Nov. 18, 2002

(65) Prior Publication Data

US 2003/0150442 A1 Aug. 14, 2003

Related U.S. Application Data

(63) Continuation of application No. PCT/AU01/00567, filed on May 18, 2001.

(30) Foreign Application Priority Data

May 18, 2000 (AU) ..... PQ7588
May 18, 2000 (AU) ..... PQ7589
May 18, 2000 (AU) ..... PQ7590

(51) Int. Cl.[7] ..... B28D 1/14; E21B 10/50
(52) U.S. Cl. ..... 125/15; 125/22
(58) Field of Search ..... 125/15, 22, 38–43; 175/393, 434, 426–428, 405.1, 420.2

(56) References Cited

U.S. PATENT DOCUMENTS

| | | | |
|---|---|---|---|
| 1,945,240 A | 1/1934 | Tupica | |
| 2,013,838 A | 9/1935 | Pickin' | |
| 2,025,260 A | 12/1935 | Zublin | |
| 2,025,261 A | 12/1935 | Zublin | |
| 2,362,860 A | 11/1944 | Rossman | |
| 2,598,518 A | 5/1952 | Dufilho | |
| 3,338,322 A | 8/1967 | Henderson | |

(List continued on next page.)

FOREIGN PATENT DOCUMENTS

| | | | |
|---|---|---|---|
| AU | 13982/88 | 11/1988 | |
| AU | 38522/89 | 3/1990 | |
| EP | 0087283 | 8/1983 | |
| EP | 0087283 A1 | 8/1983 | |
| EP | 0311422 | 4/1989 | |
| GB | 2121087 A * | 12/1983 | ..... E21C/35/18 |
| GB | 2275690 A | 9/1994 | |
| GB | 2275690 | 9/1994 | |
| SU | 172629 | 12/1986 | |
| SU | 252776 | 4/1987 | |
| SU | 279433 | 7/1987 | |

OTHER PUBLICATIONS

Introduction to De Beers PCD Drilling Materials (Brochure).
Webb, S.W. & Jackson, W.E.—Analysis of Blade Forces and Wear in Diamond Stone Cutting Transactions of the ASME, vol. 120, p 84.
Gardiner, C.F., Physical Properties of Superabrasives, Ceramic Bulletin, vol. 67, No. 6, p 1006.
Matrix Powders for Diamond Tools by Kennametal.

*Primary Examiner*—David B. Thomas
(74) *Attorney, Agent, or Firm*—Jacobson Holman PLLC

(57) ABSTRACT

A cutting tool for cutting hard rock, the cutting tool including one or more cutting elements each including a pointed or chisel-shaped body including a diamond composite material including diamond crystals bonded together by a silicon carbide matrix, the each cutting element being mounted into a supporting matrix including a metal matrix composite material, such that the point or chisel edge of the each element protrudes from the matrix.

52 Claims, 4 Drawing Sheets

U.S. PATENT DOCUMENTS 3,429,390 A 2/1969 Bennett
3,941,196 A 2/1976 Curington et al.
4,057,118 A 11/1977 Ford
4,124,401 A 11/1978 Lee et al.
4,168,755 A 9/1979 Willis
4,211,508 A 7/1980 Dill et al. ..... 407/120
4,246,977 A 1/1981 Allen
4,253,533 A 3/1981 Baker
4,303,136 A 12/1981 Ball
4,325,439 A 4/1982 Vezirian
5,282,512 A 2/1984 Besson et al.
4,491,457 A 1/1985 Pope ..... 51/308
4,533,004 A 8/1985 Ecer
4,552,231 A 11/1985 Pay et al.
4,553,615 A 11/1985 Grainger
4,558,753 A 12/1985 Barr
4,569,558 A 2/1986 Hood
4,593,777 A 6/1986 Hall
4,604,106 A 8/1986 Hall
4,608,226 A * 8/1986 Lauvinerie et al. ..... 419/5
4,646,857 A * 3/1987 Thompson ..... 175/430
4,676,124 A 6/1987 Fischer
4,719,979 A 1/1988 Jones
4,755,004 A * 7/1988 Palmquist et al. ..... 299/106
4,793,828 A 12/1988 Burnand ..... 51/293
4,813,500 A 3/1989 Jones
5,030,276 A * 7/1991 Sung et al. ..... 75/237
5,078,219 A 1/1992 Morrell et al.
5,119,714 A 6/1992 Scott et al.
5,161,627 A 11/1992 Burkett
5,213,171 A 5/1993 Clench et al.
5,282,513 A 2/1994 Jones
5,379,853 A 1/1995 Lockwood et al.
5,449,048 A 9/1995 Thigpen et al.
5,976,205 A * 11/1999 Andrews et al. ..... 51/307
6,009,962 A * 1/2000 Beaton ..... 175/426
6,176,888 B1 * 1/2001 Ritt et al. ..... 51/309
6,196,340 B1 * 3/2001 Jensen et al. ..... 175/431
6,209,660 B1 * 4/2001 Cox ..... 175/21
6,258,139 B1 * 7/2001 Jensen ..... 51/307
6,346,689 B1 * 2/2002 Willis et al. ..... 219/407
6,374,932 B1 * 4/2002 Brady ..... 175/428
6,419,574 B1 * 7/2002 Takahashi et al. ..... 451/548
2003/0123934 A1 * 7/2003 Weaver et al. ..... 404/124

* cited by examiner

CUTTING TOOL AND METHOD OF USING SAME

This is a continuation of PCT/AU01/00567, filed May 18, 2001 and published in English.

FIELD OF THE INVENTION

This invention relates to improved cutting tools for the cutting, drilling or sawing of hard materials, such as rock, stone, concrete and the like. The invention particularly relates to a pick, a saw and a drill, each including a diamond composite tip, and methods of using same.

BACKGROUND OF THE INVENTION

Machinery employed in the excavation, mining, cutting, working, or drilling of rock, stone, concrete and similar hard materials employ a variety of tools, hereinafter collectively referred to as "cutting tools". Three commonly used types of cutting tools are picks, saws and drills.

Picks

Picks are used as cutting tools in machinery used in such applications as the mining of coal and the tunnelling through of rock. The term "pick" (also called "drag-tool") typically means a pointed or chisel shaped rock cutting tool which cuts rock by penetrating and scraping along the surface of the rock. Picks typically consist of a steel shank with a tungsten carbide-cobalt material forming the cutting tip. This process produces relatively large rock fragments (or "cuttings") as compared with the finer cuttings formed using tools having tips made from diamond or polycrystalline diamond composite (PDC).

Currently, the cutting head of a piece of mining or tunnelling machinery is fitted with a number of tool holders for orientating the cutting tools at a desired angle for striking the rock (the "angle of attack"). The cutting tools are "laced", i.e. arranged in a pattern designed to effect relieved cutting, wherein as the cutting head rotates, each cutting tool has its work facilitated by the action of tools that it follows and, similarly, facilitates the work of each tool that follows it. This process allows rock fragments to be broken free with less energy than would be required if each tool had to excavate undamaged rock by unrelieved cutting.

Conventional picks, as previously stated, typically have a cutting tip formed from a tungsten-carbide-cobalt composite. These picks have a number of disadvantages.

Principally, tungsten carbide wears quickly when used to cut abrasive rock. Pointed tungsten carbide tips are designed to rotate in their holders during use so as to evenly distribute the wear. In practice, most tips do not rotate, resulting in the formation of wear flat. Even tips which do rotate as intended wear to a cone which contacts the rock surface along a line rather than at a point, thereby requiring much larger forces to fracture the rock compared to when the tip was new. Because of this wear, tungsten carbide tips can only effectively be used for cutting coal or soft rock. Accordingly, the average life span of a tungsten carbide tip is short and it must be replaced frequently.

There is clearly a need for a pick which has an increased life span, maintains a pointed shape throughout its use and which is strong and wear resistant enough to cut hard rock, such as granite.

Saws

Existing equipment for the cutting by sawing of rock, stone or concrete largely comprises impregnated diamond saw wheels and rock wheels.

Rock wheels are large wheels having pointed tungsten carbide tipped cutting elements, called "drag bits", which remove rock in a chipping action. Due to the wear characteristics of the tungsten carbide tips, rock wheels are limited to use on rocks having a strength limit of about 100 to 120 MPa, such as sandstones. Accordingly, while they can be quite successfully used on soft rocks, rock wheels cannot be used on harder rock, such as granite.

Impregnated diamond saw wheels include as cutting elements peripheral segments of metal matrix composite material containing diamond grit. The sawing action is achieved by the scraping against the rock of the tiny protruding diamond particles which causes microfracturing. With each pass of the saw, only a very small amount of rock, e.g. a few microns, is removed as very small fragments. While such saws can be used to cut hard rock, the sawing process is very energy intensive and very slow.

There is clearly a need for a saw which can be used to cut hard rock, but wears at a slower rate than prior art tungsten carbide rock wheels, but saws at a faster and more energy efficient rate than prior art impregnated diamond saw wheels.

Drills

The drilling of soft rocks (e.g. coal, sandstone) is conventionally performed using drill bits incorporating largely pointed or chisel shaped tungsten carbide cutting elements. Cutting elements of such shape are termed "drag bits" in the art. These drag bits operate using a "chipping" action, removing a relatively large amount of rock as fragments at each pass, and so drill rapidly. However, due to the rapid wear of the tungsten carbide, these drill bits are not practical for use in drilling hard rock, such as granite.

Attempts have been made to produce tungsten carbide tool tips in which a very thin layer of diamond is grown over the tungsten carbide. However, such attempts have been unsuccessful due to distortion of tungsten carbide or decomposition of diamond at high temperatures.

Much of the drilling done in strong (hard) rock is currently effected using drill bits incorporating the relatively harder materials, diamond or polycrystalline diamond compact (PDC).

Diamond impregnated bits comprise diamond fragments embedded in a metal matrix composite (MMC) material. Diamond set bits comprise relatively larger natural diamonds mounted in MMC.

Alternatively, some drilling of hard rock is done using drill bits incorporating polycrystalline diamond compact (PDC) or thermally stable PDC. These drill bits comprise discs of the PDC mounted on a tungsten carbide-cobalt composite such that the edges of the discs scrape against the rock.

In all prior art drill bits which incorporate diamond or PDC as cutting elements, the cutting of the rock is effected by scraping the cutting element across the surface of the rock. Each pass causes microfracturing and removes a very small amount of rock, typically less than 1/10 mm per pass. The rock is removed as tiny fragments, a process which is very energy intensive. The drilling process is accordingly slow, given the small amount of rock removed at each pass, and results in a drilling rate of only a meter or so per hour.

There is clearly a need for a drill bit for drilling hard rock which is strong and wears at a slower rate than prior art tungsten carbide bits, but operates more rapidly and efficiently than prior art diamond or PDC containing bits.

There have been numerous attempts to manufacture cutting tools having tips made from diamond or polycrystalline diamond composite (PDC) materials, with little success.

The present inventors have recognised that the inefficiency of prior art diamond or PDC containing cutting tools resides at least partially in the failure to provide such materials in the form of pointed or chisel shaped cutting bodies termed in the art as "drag bits". Pointed bodies are able to press into the rock surface and remove rock as relatively large fragments which requires less specific energy with each pass than that required by prior art drag bits which scrape against the rock surface producing much smaller fragments. Furthermore, pointed bodies remove more rock with each pass, which results in a more rapid cutting process.

Diamond containing materials have typically been available in only a very limited range of shapes due to limitations of the moulding and machining processes used. Those shapes are triangles, squares, rectangles and half cylinders as cut from discs and cylinders by either laser cutting or electric discharge machining (EDM). It has not been possible to produce by direct synthesis pointed bodies, such as cones.

New generation diamond composite materials have been developed with properties superior to prior art composite materials. Such materials are termed "advanced diamond composites" ("ADC") and are described, for example, in WO88/07409 and WO90/01986, the disclosures of which are incorporated herein by reference.

The ADC are typically formed by mixtures of diamond crystals and silicon to high pressures and temperatures to cause melting of the silicon which infiltrates between diamond particles and reacts with carbon of the diamonds to form silicon carbide. The silicon carbide forms a strong bond between the diamond crystals.

The diamond-silicon mixture may be placed adjacent silicon bodies during the reaction in order to enhance the infiltration of silicon into the mixture. This modification, which is the subject of WO88/07409, minimises detrimental porosity and microcracking and increases density, and thereby enhances the mechanical properties of the ADC.

In another modification, which is described in WO90/01986, a nitrogen and/or phosphorous containing material is introduced into the diamond-silicon mixture and/or the silicon bodies (if used) prior to reaction, such that the resulting silicon carbide bond in the ADC contains greater than a threshold amount of nitrogen and/or phosphorus. This threshold amount is typically 500 parts per million. The ADC product has low electrical resistivity—typically less than 0.2 ohm cm. A low electrical resistivity is advantageous in that it enables the shaping, working and machining of the ADC bodies by Electrical Discharge Machining ("EDM")—also termed "wire-cutting" or "spark erosion". EDM is far more versatile than conventional shaping techniques, such as laser cutting, both in terms of the size of bodies worked and the ranges of shapes able to be produced.

It has been found possible to mould and/or machine these ADC materials into a variety of shapes, including pointed bodies such as cones and bullet or ogival shaped bodies.

Although it is now possible to produce an effective shape using ADC materials, a further problem has been encountered, namely a means of effectively attaching the ADC bodies to tool bodies. Tool bodies are typically manufactured from steel, although they may include tungsten carbide components. The inventors have found that conventional methods of attaching the cutting tips to the tool body, such as by vacuum brazing, do not always provide a strong enough bond and the tips can accordingly break off during use. The inventors have surprisingly discovered that using a metal matrix composite to bond the cutting tip to the tool body produces a very strong and effective bond.

SUMMARY OF THE INVENTION

According to the present invention, there is provided a cutting tool for cutting hard rock, said cutting tool including one or more cutting elements each comprising a pointed or chisel shaped body including a diamond composite material including diamond crystals bonded together by a silicon carbide matrix, the or each cutting element being mounted into a supporting matrix comprising a metal matrix composite material, such that the point or chisel edge of the or each element protrudes from said matrix.

The present invention also provides a pick for cutting hard rock, said pick including one or more cutting elements each comprising a pointed or chisel shaped body including a diamond composite material including diamond crystals bonded together by a silicon carbide matrix, the or each cutting element being mounted into a supporting matrix comprising a metal composite material, such that the point or chisel edge of the or each element protrudes from said matrix.

The present invention further provides a saw for cutting hard rock, said saw including a plurality of cutting elements mounted in a supporting matrix of a metal composite material, wherein each cutting element comprises a pointed or chisel shaped body including a diamond composite material including diamond crystals bonded together by a silicon carbide matrix, and each cutting element is mounted in the metal composite material such that the point or chisel edge of each element protrudes from the matrix.

According to the present invention there is also provided a drill bit for cutting hard rock, said drill bit including a plurality of cutting elements mounted in a supporting matrix of a metal composite material, wherein each cutting element comprises a pointed or chisel shaped body including a diamond composite material including diamond crystals bonded together by a silicon carbide matrix, and each cutting element is mounted in the metal composite material such that the point or chisel edge of each element protrudes from the matrix.

Preferably the cutting element is a pointed body.

DETAILED DESCRIPTION OF THE INVENTION

Accordingly, the present inventors have developed a cutting tool which incorporates a cutting element comprising a suitably shaped body made from ADC material. The cutting element includes a mounting portion for mounting on or in the pick body and a cutting portion protruding from the pick body and carrying thereon the cutting surface. The shape of the cutting portion may be a cone, a truncated cone, a wedge, a chisel, a bullet shape, a rounded point, a flat plate, a pyramid, a triangle, a corner of a cube, a tetrahedron, a parrot's beak or a snow plough shape.

As previously noted, while the cutting tips of prior art tools have usually been attached to the tool body by a brazing process, the inventors have found that brazing of an ADC tip to either a WC or steel base does not provide a strong enough bond. Instead, the inventors have surprisingly found that bonding the ADC tip to a WC or steel substrate using a metal matrix composite provides a very strong and durable bond. Further, metal matrix composite provides a highly suitable matrix for embedding ADC elements therein.

The composition of the metal matrix composite material can vary but typically contains as major components copper, zinc, silver and tin. The composite can also contain tungsten carbide grains. Such metal matrix composite can suitably be formed using metallic powders, such as those sold as "Matrix Powders" by Kennametal. One such suitable powder is type P-75S Matrix Powder. The metallic powders are turned into a solid metal composite by sintering under pressure. In one form of the invention, the composite is formed by a fusion process, in which the metal powders partially melt and are squeezed together and densified. Alternatively the composite may be formed by a process of infiltration in which a molten metal is added to the powder under pressure and the molten metal fills the interstices between powder particles.

Preferably at least the cutting portion of the cutting element is conical, bullet or ogival shaped, with the apex forming the cutting tip. Preferably the cutting element comprises a tapered, elongate body and an ogival head. The overall shape of the cutting element may be similar to a 22 calibre rifle projectile. A bullet shaped cutting tip is preferred to a cone shaped tip as it is inherently stronger and less likely to break.

The mounting portion of the cutting element is preferably not straight sided but is instead tapered towards the cutting tip. That is, it is preferred that the mounting portion be frustoconical, instead of cylindrical because a frustoconical shape has inherently greater strength than a cylindrical shape.

Another preferred shape of the cutting element is a "double cone", based upon the shape of two cones joined together at their bases. One of the cones forms a mounting portion and is received in a recess provided in the tool body and/or the metal matrix composite, while the other cone forms the cutting portion and protrudes from the tool body for contact with the rock being excavated. The cones may be of differing height, with the more elongate cone being received in the recess and/or MMC and the squat cone forming the cutting tip. The double cone shape is advantageous in that it requires only a minimum amount of diamond composite material and therefore is relatively inexpensive to manufacture. The cone forming the cutting portion may have advantageously a bullet shaped or ogival profile, which as previously stated, provides a stronger cutting tip than a conical profile.

Pick

The pick preferably includes a steel shank at one end thereof, for attachment to a tool holder, with the cutting element provided at the other end.

The mounting portion of the cutting element is preferably at least partly received in a recess provided in the pick body and therefore needs to be sufficiently elongated to ensure that a sufficient length of the cutting portion protrudes to enable cutting to be effected. There is preferably a gap between the mounting portion and the inner surface of the recess to accommodate enough metal matrix composite material to bond the cutting element in place. By mounting the cutting element in a recess, the subsequent bond is considerably stronger.

The recess into which is received the mounting portion of the cutting element is shaped so as to complement the shape of the mounting portion. Accordingly, where the mounting portion is frustoconical, the recess is preferably also frustoconical and where the mounting portion is conical, the recess is also preferably conical.

The gap between the mounting portion and the recess wall is filled with a metal matrix composite material, which bonds the cutting element to the pick body.

The pick body may further include a tungsten carbide component in addition to the steel component. In such an embodiment, the steel component preferably forms at least part of the shank with the tungsten carbide component brazed thereto and housing the recess for receiving the cutting element. Again, MMC is used to bond the cutting tip to the pick body.

The addition of tungsten carbide having an intermediate flexibility between the steel and ADC components enhances the overall strength of the pick. Moreover, MMC also has modulus of elasticity intermediate those of steel and ADC and similarly enhances the overall strength, even where there is no intervening tungsten carbide present.

The present inventors have also discovered that superior cutting results are achieved by using the pick of the invention, at an angle of attack different from the angle conventionally used for prior art picks.

Conventionally, picks are orientated in their tool holders such that in use the "angle of attack", i.e. the angle between the surface of the rock being cut and the axis of the pick, is about 40° to 60°. Such an angle has previously been necessary due to the particular wear characteristics of the dominantly WC—Co cutting tips.

However, the present inventors have found that in using the pick of the present invention, far superior results are obtained at a higher angle of attack that is above 60°. Preferably the angle of attack is in the range of 60° to 80° more preferably, 65° to 75° most preferably about 70°. This steeper angle of attack is made possible due to the cutting element being considerably harder than those of the prior art, resulting in a different wearing pattern. Also, it has been found that using some embodiments of the pick of the invention at the conventional lower angles of attack can, under some circumstances, result in detachment of the cutting element from the pick body. However, by increasing the angle of attack to above 60°, the force applied to the cutting tip runs as close as possible to the axis of rotation of the pick, so that there is a minimum bending movement applied to the cutting tip which could cause the cutting element to detach.

Saw

As previously noted, the inventors have surprisingly found that metal matrix composite materials provide a highly suitable matrix for embedding the ADC cutting elements therein. The saw of the invention preferably comprises a substantially circular saw body having the cutting elements mounted about its periphery to thereby form a cutting face.

In one embodiment the saw body includes a plurality of arcuate cutting segments receivable on and spaced about the periphery of the saw body. Each cutting segment typically comprises a plurality of cutting elements mounted in MMC such that the cutting segments jointly make up the cutting face.

In a preferred embodiment, the saw was manufactured by mounting the cutting elements directly into holes or apertures provided about the periphery of the saw body. The cutting elements were set into place using MMC provided in each hole.

Preferably, the cutting elements arranged on the saw are laced. That is, the cutting elements are arranged in a pattern designed to effect relieved cutting: as the saw rotates, each cutting element has its work facilitated by the action of cutting elements it follows and, similarly, facilitates the work of each cutting element that follows it. This process allows rock fragments to be broken free with less energy than would be required if each tool had to excavate undamaged rock by unrelieved cutting. It is to be noted that it has not been possible to lace prior art tungsten carbide cutting elements as they have to be comparatively larger and to follow one another in the same groove. Using the saw of the present invention, it has been possible to remove rock at the astonishing rate of 1 mm each pass.

Conventional WC—Co drag bits are orientated in use such that the "angle of attack", i.e. the angle between the surface of the rock being cut and the axis of the drag bit is about 40°, to 60°. Such an angle has previously been necessary due to the particular wear characteristics of the WC—Co cutting tips.

However, the present inventors have found that in using the saw of the present invention, far superior results are obtained where the cutting elements are mounted in the saw body and/or supporting matrix such that the angle of attack of each cutting element is in the range of 60° to 80°. More preferably, the angle of attack is in the range of 65° to 75°, most preferably about 70°. This steeper angle of attack is made possible due to the cutting elements being considerably harder than those of the prior art resulting in different wear characteristics.

A saw incorporating the ADC cutting elements supported in a metal matrix composite material provides highly superior cutting performance over any of the saws of the prior art. The saw of the invention can cut through hard rock very rapidly, advancing by a millimeter at each pass, corresponding to 1 meter a minute for a speed of 1000 rpm. This cutting rate is many times faster than a diamond impregnated saw, and can be largely attributable to the process of indentation by the pointed cutting elements and formation of crack propagation. Such a process is considerably different to the cutting action of any existing saw. Moreover, the saw of the invention is able to cut a slot in rock having a width which is considerably smaller than that produced by prior art rock wheels, meaning that there is less rock wastage.

The advantages of the saw of the invention are summarised below:

(i) The saws are able to cut strong rock such as granite, which has not previously been possible with prior art drag bit saws.

(ii) Cutting is more rapid due to a process of crack propagation and chip formation, producing macroscopic fragments, unlike the slower, micro fracture process of rock cutting used by conventional impregnated diamond saw wheels.

(iii) It is possible to exploit the advantages of lacing the drag bits, which has not been possible with conventional tools utilising tungsten carbide drag bits due to the latter's larger size and their need to follow each other in the same groove during cutting.

(iv) Smaller forces are required for a given excavation rate compared with prior art saws having tungsten carbide drag bits.

(v) Similarly, excavation rates are higher for a given applied force than for prior art saws having tungsten carbide drag bits.

(vi) The saws of the invention can excavate with a superior specific energy of excavation due to the production of macroscopic chips, as compared with conventional diamond saws.

Drill Bit

A drill bit in accordance with the present invention incorporates a plurality of cutting elements, each comprising a "drag bit", i.e. a pointed body made from ADC material. Each cutting element includes a mounting portion for mounting in the metal matrix composite material, and a cutting portion protruding from the supporting matrix and carrying thereon the cutting surface.

The drill bit of the present invention may comprise a simple drill bit for drilling holes or a core drill bit. A core drill bit is annular in shape and drills an annular hole with the core thereby produced being able to be retrieved and examined for information about the geology of the rock through which the hole has passed.

There are different methods available for bringing the rock core or cuttings from the hole to the surface. A flow of drilling fluid comprising air, water or mud is typically circulated during drilling to cool the drill bit, and can also be used to bring rock cuttings to the surface. In conventional circulation, the drilling fluid travels to the bottom of the hole down the inside of the pipe string joined to the drill bit. In reverse circulation, the drilling fluid flows down the outside of the pipe string and up the inside of the pipe string where the pipe string is a dual wall tube, having one pipe within another, the drilling fluid flows down the annular space between the pipes, then up the central pipe.

In one preferred embodiment of the invention, the drill bit of the invention is used in a dual pipe reverse circulation core drilling. The drill bit includes a core breaker for breaking the core into short lengths as the core drilling proceeds. The lengths of core are then lifted to the surface up the central pipe by the drilling fluid.

The drill bit preferably comprises an annular or cylindrical drill bit body having a plurality of cutting elements mounted in MMC at one end of the body to form a cutting face. The annular or cylindrical drill bit body has an inner wall and an outer wall which preferably contain drilling fluid channels formed therein through which drilling fluid can pass during use.

As was the case with the saw of the invention, it is preferred that the cutting elements of the drill are laced. That is, the cutting elements are arranged in a pattern designed to effect relieved cutting: as the drill bit rotates, each cutting element has its work facilitated by the action of cutting elements it follows and, similarly, facilitates the work of each cutting element that follows it. This process allows rock fragments to be broken free with less energy than would be required if each tool had to excavate undamaged rock by unrelieved cutting. It is to be noted that it has not been possible to lace prior art tungsten carbide bits as they have to be comparatively larger and to follow one another in the same groove.

Using the drill bit of the present invention, it has been possible to remove rock at the astonishing rate of 1 mm each pass.

Conventional WC—Co drag bits are orientated in use such that the "angle of attack", i.e. the angle between the surface of the rock being cut and the axis of the drag bit is about 40° to 60°. Such an angle has previously been necessary due to the particular wear characteristics of the WC—Co cutting tips.

However, the present inventors have found that in using the drill bit of the present invention, far superior results are obtained where the cutting elements are mounted in the supporting matrix such that the angle of attack of each cutting element is in the range of 60° to 80°. More preferably, the angle of attack is in the range of 65° to 75°, most preferably about 70°. This steeper angle of attack is made possible due to the cutting elements being considerably harder than those of the prior art resulting in different wear characteristics.

The advantages of the drill bit of the invention are summarised below:

(i) The drill bits are able to cut strong rock such as granite, which has not previously been possible with prior art drag bit drill bits.

(ii) Cutting is more rapid due to a process of crack propagation and chip formation, producing macroscopic fragments, unlike the slower, microfracture process of rock cutting used by conventional diamond and PDC drill bits.

(iii) It is possible to exploit the advantages of lacing the drag bits, which has not been possible with conventional tools utilising tungsten carbide drag bits due to the latter's larger size and their need to follow each other in the same groove during cutting.

(iv) Smaller forces are required for a given excavation rate compared with prior art drill bits having tungsten carbide drag bits.

(v) Similarly, excavation rates are higher for a given applied force than for prior art drill bits having tungsten carbide drag bits.

(vi) The drill bits of the invention can excavate with a superior specific energy of excavation due to the production of macroscopic chips, as compared with conventional diamond and PDC drill bits.

In order that the invention can be more readily understood, non-limiting embodiments thereof are now described with reference to the accompanying drawings.

DETAILED DESCRIPTION OF THE PREFERRED EMBODIMENTS

Figure 2:
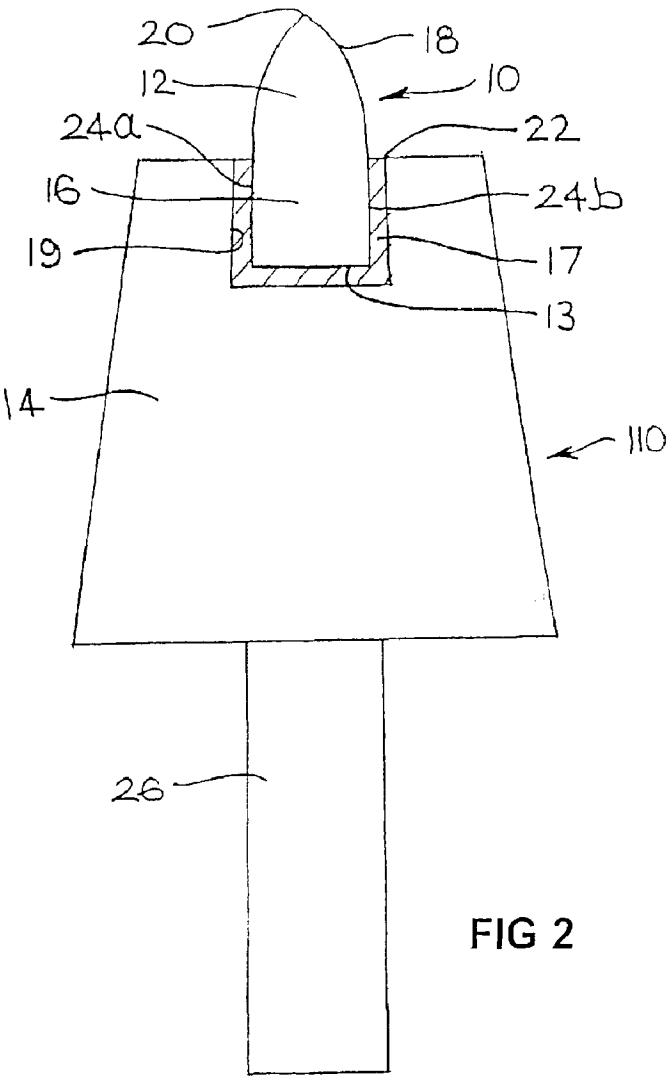
FIG. 2 is a schematic cross-sectional view of a pick according to a first embodiment of the present invention.

In the following detailed description of the preferred embodiments as illustrated in the accompanying drawings, like reference numerals refer to like parts.

Figure 1:
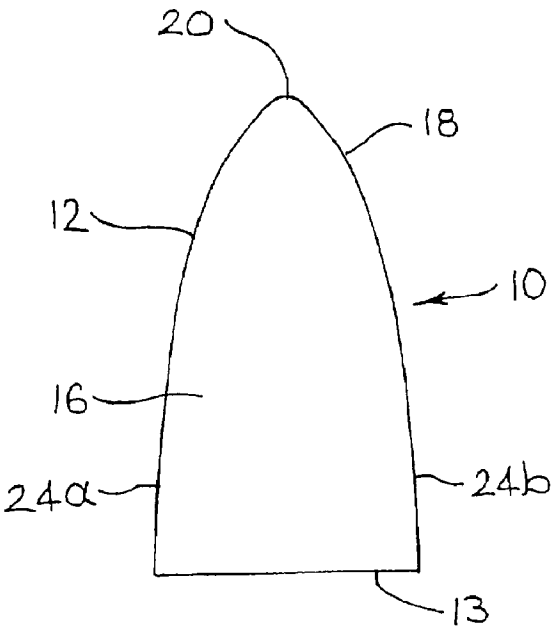
FIG. 1 is a schematic view of a cutting element used in the cutting tools of the present invention.

FIG. 1 shows a cross section of a cutting element 10 comprising a pointed body 12 formed from ADC. The cutting element 10 comprises a base 13, an elongate mounting portion 16, which is adapted to be received in the supporting matrix of a tool body (not shown) and a cutting portion 18 on which is provided the cutting surface or point 20. The cutting point 18 is ogival, or bullet shaped whereas the sides 24*a*, 24*b* of the mounting portion 16 taper inwardly from the base 13 to the cutting portion 18.

In FIG. 2, a pick 110 is illustrated which includes a cutting element 10 comprising a pointed body 12 formed from ADC mounted in a pick body 14 made from steel. The cutting element 12 includes the features as illustrated in FIG. 1 which will not be repeated here. The elongate mounting portion 16 is mounted in a recess 17 in the pick body 14, and the cutting portion 18 protrudes from the recess 17 and carries thereon the cutting surface, or point 20.

Bonding the cutting element 12 to the pick body 14 is a layer of metal matrix composite (MMC) material 22.

The inner surface 19 of recess 17 is shaped so as to complement the shape of the mounting portion 16, with a sufficient gap therebetween to receive therein the MMC material. Given the large difference in the modulus of elasticity between steel and ADC, there is preferably no direct contact between the cutting element 12 and the pick body 14, but instead complete separation of the two by the intervening layer of MMC 22.

The pick body 14 further includes a shank 26 for attachment to a tool holder.

Figure 3:
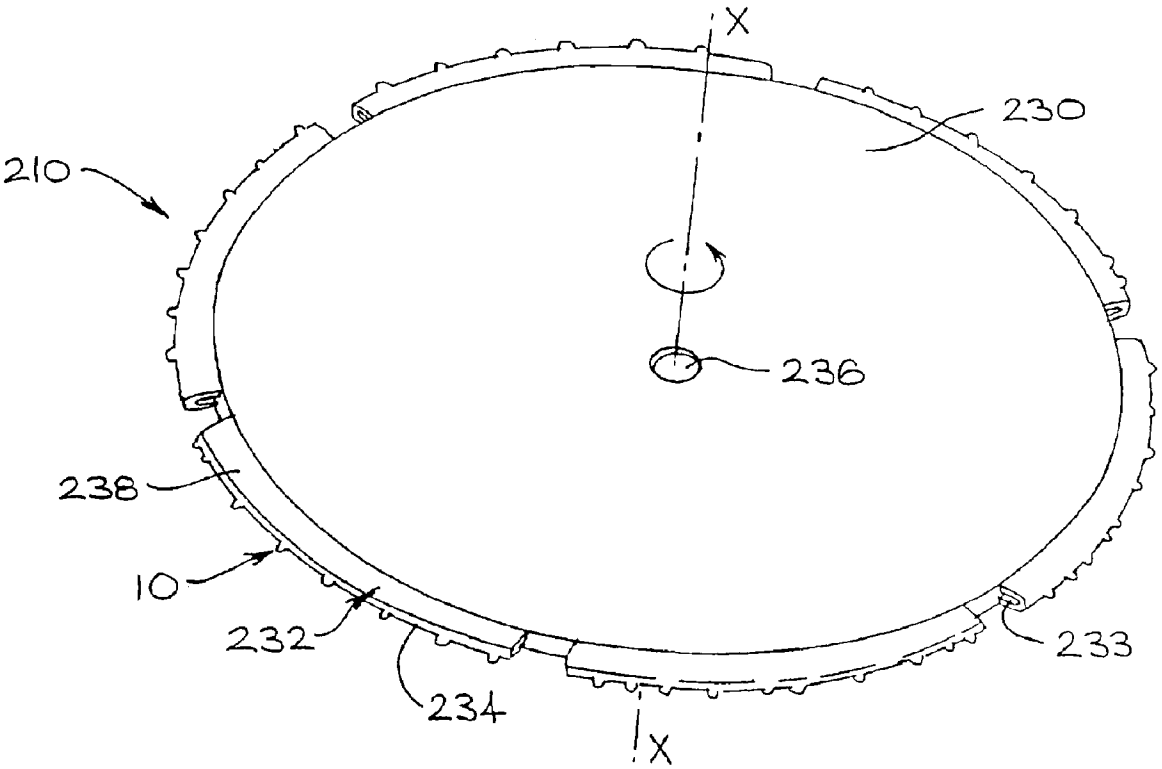
FIG. 3 is a perspective view of a saw according to a second embodiment of the present invention.

With reference to FIG. 3, a saw 210 comprises a circular saw body 230 having a plurality of cutting segments 232 spaced about its periphery thereby forming a cutting face 234. The saw body 230 has a central aperture 236 for mounting on a motor driven spindle (not shown) to thereby effect rotation about the axis X—X.

Figure 3A:
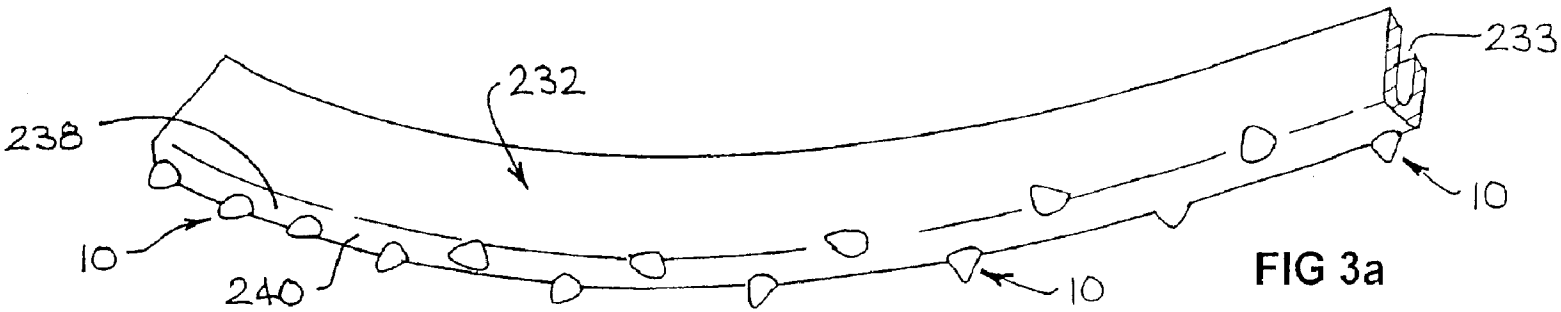
FIG. 3*a* is a detailed perspective view of a cutting segment of the saw illustrated in FIG. 3.

FIG. 3*a* shows the detail of a cutting segment 232. The cutting segment 232 includes an inner, circumferential channel 233 which is received on the peripheral edge of the saw body 230. The cutting segment 232 comprises a plurality of cutting elements 10 (as illustrated in FIG. 1) which are set in a supporting matrix 238 to thereby give the cutting face 234. The supporting matrix 238 is comprised of metal matrix composite material. The metal matrix composite material is suitably formed by using metallic powder sold as "Matrix Powders" by Kennametal. One such suitable powder is type P-75S Matrix Powder.

The cutting elements 10 are "laced", that is they are arranged on the cutting face 240 such that as the saw 210 rotates, each cutting element 10 exploits relieved cutting from other cutting elements 10 that it follows and it in turn provides relieved cutting opportunity for each of the following cutting elements 10. Moreover, each cutting element 10 is orientated such that in use, the angle between the surface of the rock being cut and the axis of the cutting element 18 is in the range of 60° to 80°.

Figure 4:
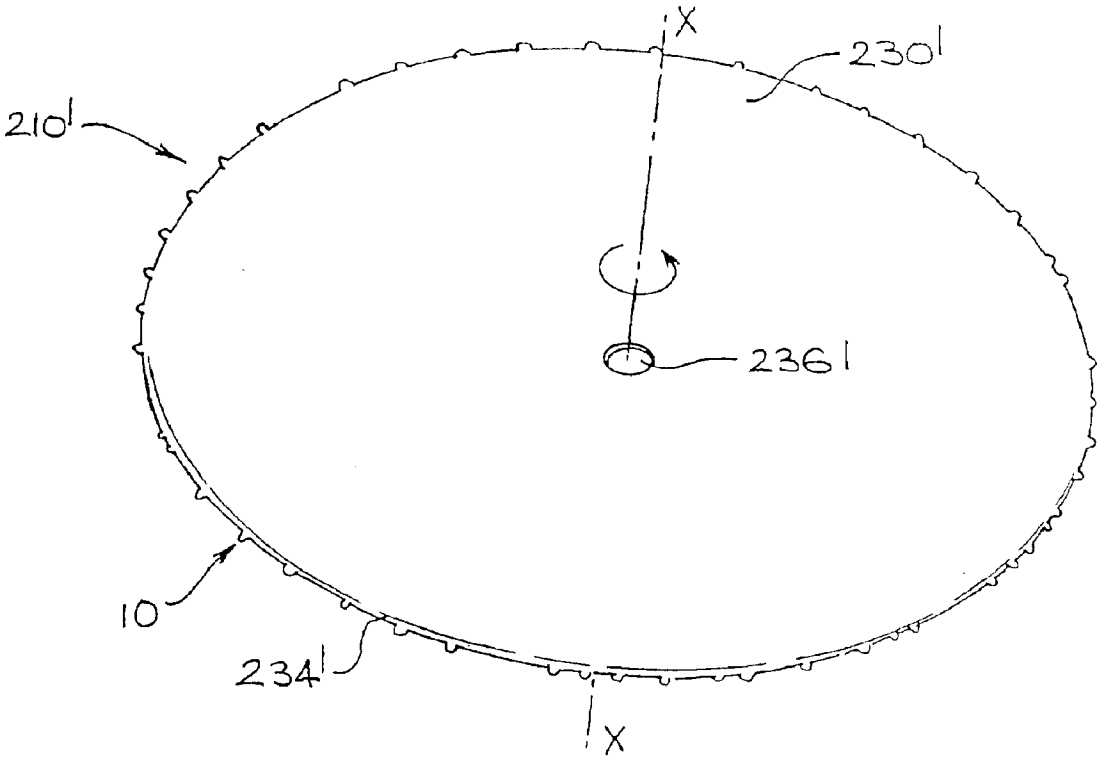
FIG. 4 is a perspective view of a modified version of the saw illustrated in FIG. 3.
Figure 4A:
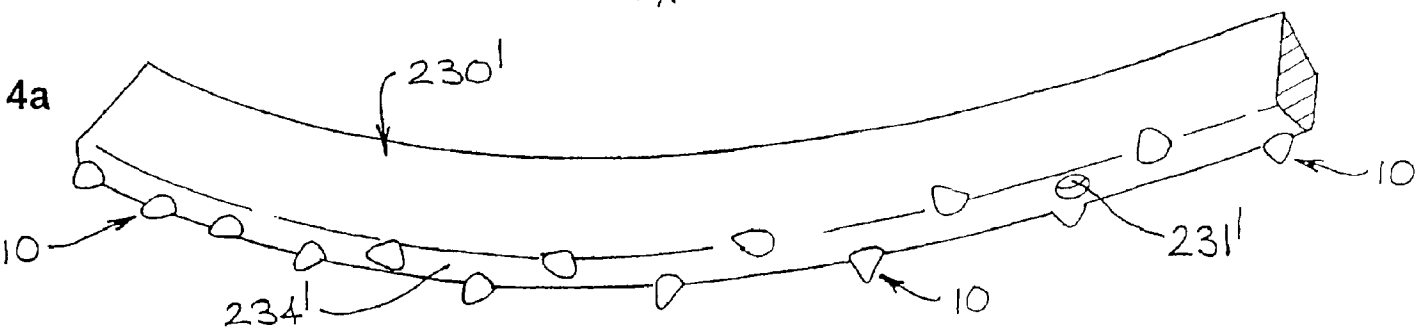
FIG. 4*a* is a detailed cut-away view of the periphery of the saw illustrated in FIG. 4.

FIGS. 4 and 4*a* illustrate a variation on the saw embodiment of FIGS. 3 and 3*a*. The principal difference between the respective saw embodiments of FIGS. 4 and 3 is that in FIG. 4, the cutting face 234' is integral with, and circumferentially continuous about the periphery of, the saw body 230'. The saw 210' of FIG. 4 is constructed by drilling apertures 231' directly into the saw body 210'. FIG. 4*a* illustrates an aperture 231' in a partial cut-away view of the saw body 210'. The cutting elements 10 are placed into the apertures 231' and arranged into the desired orientation using MMC to bond the cutting elements into place.

Figure 5:
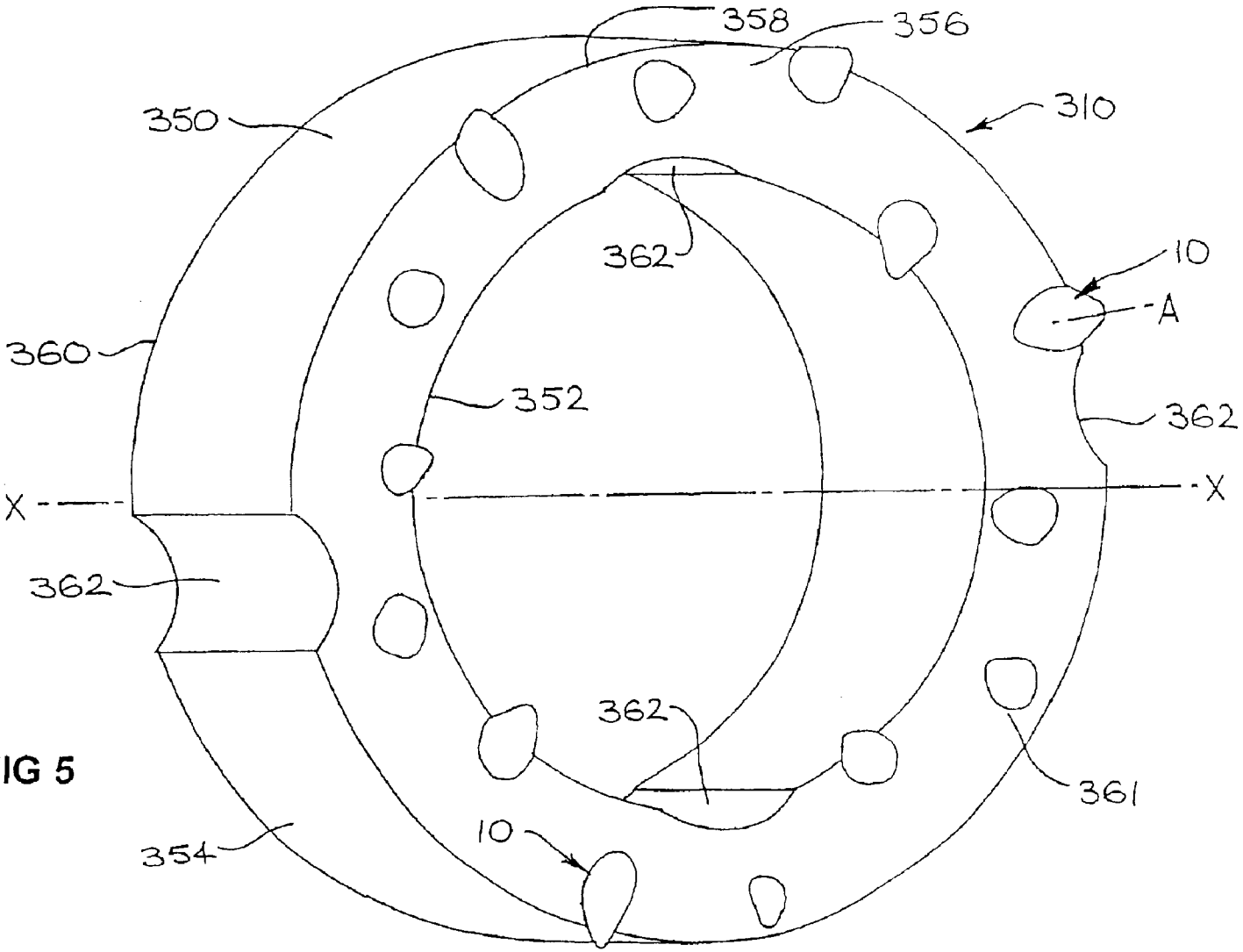
FIG. 5 is a perspective view of a coring drill bit according to a third embodiment of the present invention.

Turning now to FIG. 5, a coring drill bit 310 includes an annular drill bit body 350, having an inner wall 352 and an outer wall 354, and a plurality of cutting elements, or drag bits 10 mounted therein. The cutting elements 10 are illustrated in FIG. 1. The drill bit body 350 includes a cutting face 356 at the leading end 358 and means for attachment to a drill string (not shown) at the trailing end 360. The cutting elements 10 are set in a supporting matrix 361 provided at the cutting face 356. The matrix is comprised of a metal matrix composite material. The metal matrix composite material is suitably formed by using metallic powder sold as "Matrix Powder" by Kennametal. One such suitable powder is type P-75S Matrix Powder.

The drill bit body 350 is also provided with drilling fluid channels 362 in the inner 352 and outer 354 walls of the drill bit body 350, for the passage of drilling fluid during use.

Again, the cutting elements 10 are "laced", that is they are arranged on the cutting face 356 such that as the drill bit 310 rotates, each cutting element 10 exploits relieved cutting from other cutting elements 10 that it follows and in turn provides relieved cutting opportunity for each of the following cutting elements 10. It is to be noted that despite the different orientations of the cutting elements, the axis A passing through the point of each cutting element 10 is at an angle of approximately 70° to the axis of rotation X—X of the drill bit 310.

Finally, it is to be understood that various alterations, modifications and/or additions may be introduced into the constructions and arrangements of parts previously described without departing from the spirit or ambit of the invention.

What is claimed is:

1. A cutting tool for cutting hard rock, said cutting tool comprising a tool body, and one or more cutting elements each having a pointed body formed from a diamond composite material including diamond crystals bonded together by a silicon carbide matrix, the or each cutting element being bonded in or on the tool body using a composite metal matrix material as a bonding medium to bond to both the cutting element and the tool body, such that the point of the or each element protrudes from said tool body.

2. The cutting tool of claim 1, wherein said cutting tool is selected from the group consisting of a pick, a saw and a drill.

3. The cutting tool of claim 1, wherein a cutting portion of the or each cutting element is one of conical, bullet and ogival shaped.

4. The cutting tool of claim 1, wherein the composite metal matrix material contains as major components copper, zinc, silver and tin, and said metal matrix composite material further includes tungsten carbide grains, formed by fusion.

5. The cutting tool of claim 1, wherein said cutting element has a tapered elongate body forming a mounting portion which tapers inwardly toward a bullet or ogival shaped head forming a cutting portion.

6. The cutting tool of claim 1, wherein the or each said cutting element is mounted in said supporting matrix such that the angle of the attack of said cutting element is greater than 60°.

7. The cutting tool of claim 6, wherein said angle of attack is in the range from 60° to 80°.

8. The cutting tool of claim 6, wherein said angle of attack is in the range from 65° to 75°.

9. A method of cutting hard rock, said method comprising the steps of forming a cutting tool comprising one or more cutting elements each having a pointed body including a diamond composite material including diamond crystals bonded together by a silicon carbide matrix, the or each cutting element having a tapered, elongate body forming a mounting portion which tapers inwardly toward a bullet or ogival shaped head forming a cutting portion, and cutting the hard rock with said cutting tool at an angle of attack between 60° and 80°.

10. A cutting tool for cutting hard rock, said cutting tool comprising a tool body and one or more cutting elements formed from an advanced diamond composite material including diamond crystals bonded together by a silicon carbide matrix, the or each cutting element having a tapered, elongate body forming a mounting portion and a bullet or ogival shaped head forming a cutting portion, the or each cutting element being mounted by said mounting portion in or on said tool body using a metal matrix composite material as a bonding medium such that said cutting portion protrudes from said tool body, the or each said cutting element being mounted in said supporting matrix such that the angle of the attack of said cutting element is in the range from 60° to 80°.

11. The cutting tool of claim 10, wherein said elongate body is tapered inwardly in a direction towards said cutting portion, and is frustoconical.

12. The cutting tool of claim 10, wherein said tapered elongate body is tapered inwardly in a direction away from said cutting portion and is conical.

13. A pick for cutting hard rock, said pick comprising a pick body, including a shank at one end thereof for attachment to a tool holder and a cutting element provided at the other end of the pick body, said cutting element being formed from an advanced diamond composite material including diamond crystals bonded together by a silicon carbide matrix, said cutting element having a tapered, elongate body forming a mounting portion, which tapers inwardly toward a bullet or ogival shaped head forming a cutting portion, said mounting portion of said cutting element being at least partially received in a recess provided in said pick body and said mounting portion being bonded in place by a layer of a composite metal matrix material as a bonding medium to bond to both the mounting portion and the pick body, such that said cutting portion protrudes from said recess.

14. The pick of claim 13, wherein said pick body is formed from steel.

15. The pick of claim 13, wherein said elongate body is frustoconical.

16. The pick of claim 13, wherein the composite metal matrix material contains as major components copper, zinc, silver and tin, said composite metal matrix material further includes tungsten carbide grains.

17. The pick of claim 13, wherein said recess is shaped so as to complement the shape of the mounting portion.

18. The pick of claim 13, wherein said shank is formed at least partially of steel and said pick body further includes a tungsten carbide component housing said recess.

19. A method of using a pick of claim 13, including the step of orientating said pick such that the angle of attack is greater than 60°.

20. A method of cutting hard rock, said method comprising the steps of:

forming a pick having a pick body, including a shank at one end thereof for attachment to a tool holder and a cutting element provided at the other end of the pick body, said cutting element being formed from an advanced diamond composite material including diamond crystals bonded together by a silicon carbide matrix, said cutting element having a tapered, elongate body forming amounting portion, which tapers inwardly toward a bullet or ogival shaped head forming a cutting portion, wherein said mounting portion of said cutting element is at least partially received in a recess provided in said pick body and is bonded in place by a layer of a metal matrix composite material, such that said cutting portion protrudes from said recess; and cutting the hard rock with said pick at an angle of attack between 60° and 80°.

21. The method of claim 20, wherein said angle of attack is about 70°.

22. The method of claim 20, wherein said angle of attack is between 65 and 75°.

23. A saw for cutting hard rock, said saw comprising a plurality of cutting elements mounted in a supporting matrix of a metal composite material, each cutting element being formed from an advanced diamond composite material including diamond crystals bonded together by a silicon carbide matrix, the or each cutting element having a mounting portion and a bullet or ogival shaped cutting portion, each cutting element being mounted by said mounting portion in said supporting matrix such that said cutting portion protrudes from said supporting matrix and being orientated such that in use, an angle between an axis of said cutting element and a surface of the rock being cut being between 60° and 80°.

24. The saw of claim 23, wherein each said cutting element further includes a tapered elongate body and a head forming said cutting portion, said tapered elongate body forming a mounting portion for mounting said cutting element into said supporting matrix.

25. The saw of claim 24, wherein said elongate body is tapered inwardly in a direction towards said cutting portion.

26. The saw of claim 24, wherein said tapered elongate body is tapered inwardly in a direction away from said cutting portion.

27. The saw of claim 24, wherein said elongate body is frustoconical.

28. The saw of claim 24, wherein said tapered elongate body is conical.

29. The saw of claim 23, wherein the metal matrix composite material contains as major components copper, zinc, silver and tin, and said metal matrix composite material further includes tungsten carbide grains.

30. The saw of claim 23, wherein said cutting elements are laced.

31. The saw of claim 23, wherein said angle is between 65° and 75°.

32. The saw of claim 23, wherein said angle is about 70°.

33. A saw for cutting hard rock, said saw comprising a plurality of cutting elements mounted in a supporting matrix of a metal composite material, each cutting element being formed from an advanced diamond composite material including diamond crystals bonded together by a silicon carbide matrix, the or each cutting element having a mounting portion and a bullet or ogival shaped cutting portion, each cutting element being mounted by said mounting portion in said supporting matrix such that said cutting portion protrudes from said supporting matrix and being orientated such that in use, an angle between the axis of said cutting element and a surface of the rock being cut is between 60° and 80°, and a substantially circular saw body having said cutting elements mounted about the periphery thereof to thereby form a cutting face.

34. The saw of claim 33, wherein the cutting elements are mounted in apertures provided about the periphery of said saw body and bonded into place using said metal matrix composite material.

35. A drill bit for cutting hard rock, said drill bit comprising a plurality of cutting elements mounted in a supporting matrix of a metal composite material, each cutting element being formed from an advanced diamond composite material including diamond crystals bonded together by a silicon carbide matrix, the or each cutting element having a mounting portion and a bullet or ogival shaped cutting portion, each cutting element being mounted by said mounting portion in said supporting matrix and being oriented such that in use, an angle between an axis of said cutting element and a surface of the rock being cut being between 60° and 80°.

36. The drill bit of claim 35, wherein said angle is between 65° and 75°.

37. The drill bit of claim 35, wherein said angle is about 70°.

38. The drill bit of claim 35, wherein each said cutting element further includes a tapered elongate body and a head forming said cutting portion, said tapered elongate body forming a mounting portion for mounting said cutting element into said supporting matrix.

39. The drill bit of claim 38, wherein said elongate body is tapered inwardly in a direction towards said cutting portion.

40. The drill bit of claim 38, wherein said tapered elongate body is tapered inwardly in a direction away from said cutting portion.

41. The drill bit of claim 38, wherein said elongate body is frustoconical.

42. The drill bit of claim 38, wherein said elongate body is conical.

43. The drill bit of claim 35, wherein the metal matrix composite material contains as major components copper, zinc, silver and tin, and said metal matrix composite material further includes tungsten carbide grains.

44. The drill bit of claim 35, comprising a coring drill bit.

45. The drill bit of claim 35, wherein said cutting elements are laced.

46. A drill bit for cutting hard rock, said drill bit comprising a plurality of cutting elements mounted in a supporting matrix of a metal composite material, each cutting element being formed from an advanced diamond composite material including diamond crystals bonded together by a silicon carbide matrix, the or each cutting element having a mounting portion and a bullet or ogival shaped cutting portion, each cutting element being mounted by said mounting portion in said supporting matrix and being oriented such that in use, an angle between an axis of said cutting element and a surface of the rock being cut is between 60° and 80°, and an annular drill bit body having a plurality of said cutting elements mounted in said supporting matrix at one end thereof to form a cutting face.

47. The drill bit of claim 46, wherein said annular drill bit body has an inner wall and an outer wall having drilling fluid channels therein for passage of drilling fluid during use.

48. Machinery for use in cutting hard rock, said machinery comprising a cutting tool including a tool body and one or more cutting elements formed from a diamond composite material including diamond crystals bonded together by a silicon carbide matrix, the or each cutting element having a tapered, elongate body forming a mounting portion and a bullet or ogival shaped head forming a cutting portion, the or each cutting element being mounted by said mounting portion in or on said tool body using a metal matrix composite material as a bonding medium such that said cutting portion protrudes from said tool body, said cutting tool being orientated such that in use, an angle between an axis of said cutting element and a surface of the rock being cut being between 60° and 80°.

49. Machinery of claim 48, wherein said angle is between 65° and 75°.

50. Machinery of claim 48, wherein said angle is about 70°.

51. A saw for cutting hard rock, said saw comprising a substantially circular saw body and a plurality of cutting elements mounted about a periphery thereof to thereby form a cutting face, each cutting element being formed from a diamond composite material including diamond crystals bonded together by a silicon carbide matrix, the or each cutting element having a mounting portion and a bullet or ogival shaped cutting portion, the mounting portion of each cutting element being at least partially received in a respective recess provided in said saw body and being bonded in place by a layer of metal matrix composite material such that each said cutting portion protrudes from a corresponding recess and being orientated such that in use, an angle between an axis of said cutting element and a surface of the rock being cut being between 60° and 80°.

52. A drill bit for cutting hard rock, said drill bit comprising a drill bit body an a plurality of cutting elements extending therefrom to form a cutting face, each cutting element being formed from a diamond composite material including diamond crystals bonded together by a silicon carbide matrix, the or each cutting element having a mounting portion and a bullet or ogival shaped cutting portion, the mounting portion of each cutting element being at least partially received in a respective recess provided in said drill bit body and being bonded in place by a layer of metal matrix composite material such that each said cutting portion protrudes from a corresponding recess and being oriented such that in use, an angle between an axis of said cutting element and a surface of the rock being cut being between 6° and 80°.

* * * * *

UNITED STATES PATENT AND TRADEMARK OFFICE

CERTIFICATE OF CORRECTION

PATENT NO. : 6,868,848 B2
DATED : March 22, 2005
INVENTOR(S) : Boland et al.

It is certified that error appears in the above-identified patent and that said Letters Patent is hereby corrected as shown below:

Column 4,
Line 60, after "material" insert -- or composite metal matrix material --.

Column 16,
Line 12, change "6°" to -- 60° --.

Signed and Sealed this

Twelfth Day of July, 2005

JON W. DUDAS
*Director of the United States Patent and Trademark Office*